US009361832B2

(12) United States Patent
Sugimoto

(10) Patent No.: US 9,361,832 B2
(45) Date of Patent: Jun. 7, 2016

(54) DISPLAY DEVICE AND SCANNING LINE DRIVER

(71) Applicant: Futaba Corporation, Mobara-shi, Chiba-ken (JP)

(72) Inventor: Terukazu Sugimoto, Mobara (JP)

(73) Assignee: FUTABA CORPORATION, Mobara-Shi (JP)

( * ) Notice: Subject to any disclaimer, the term of this patent is extended or adjusted under 35 U.S.C. 154(b) by 70 days.

(21) Appl. No.: 14/208,450

(22) Filed: Mar. 13, 2014

(65) Prior Publication Data

US 2014/0267199 A1 Sep. 18, 2014

(30) Foreign Application Priority Data

Mar. 14, 2013 (JP) ..... 2013-051683

(51) Int. Cl.
*G09G 3/00* (2006.01)
*G09G 3/32* (2016.01)

(52) U.S. Cl.
CPC ..... *G09G 3/3266* (2013.01); *G09G 2310/0221* (2013.01); *G09G 2310/0283* (2013.01); *G09G 2310/0286* (2013.01); *G09G 2330/021* (2013.01)

(58) Field of Classification Search
CPC ..... G09G 3/20; G09G 3/2085; G09G 3/2088; G09G 2310/0224; G09G 2310/0283
See application file for complete search history.

(56) References Cited

U.S. PATENT DOCUMENTS 6,246,385 B1 * 6/2001 Kinoshita ..... G09G 3/3644 345/100
2010/0013825 A1 * 1/2010 Takahashi ..... G09G 3/3216 345/214

FOREIGN PATENT DOCUMENTS

JP H11-295696 A 10/1999
WO 2008/111182 A1 9/2008

OTHER PUBLICATIONS

Japanese Office Action dated Feb. 26, 2015 issued in corresponding Japanese application No. 2013-051683 and English translation thereof.
Chinese Office Action, including search report, dated Jan. 4, 2016 issued in corresponding Chinese Patent Application No. 201410093278.8 and English translation thereof.
Korean Office Action dated Aug. 26, 2015 issued in corresponding Korean Patent Application No. 10-2014-0030214 and English translation thereof.

* cited by examiner

*Primary Examiner* — Charles Hicks
(74) *Attorney, Agent, or Firm* — Bacon & Thomas, PLLC

(57) ABSTRACT

A display device includes: a display unit having m scanning lines and a first and a second scanning line drive unit for respectively applying scanning signals to one ends and the other ends of the scanning lines. The first scanning line drive unit performs a forward scanning signal output to sequentially select the scanning lines, while outputting scanning signals having a first blanking period from the odd-numbered output terminals and scanning signals having a second blanking period shifted from the first blanking period, from the even-numbered output terminals, and the second scanning line drive unit performs, in synchronization with the first scanning line drive unit, a reverse scanning signal output to sequentially select the scanning lines, while outputting scanning signals having the second blanking period from the odd-numbered output terminals and scanning signals having the first blanking period from the even-numbered output terminals.

2 Claims, 12 Drawing Sheets

CLK
DT
SHIFT REGISTER
LATCH CIRCUIT
DRIVE CIRCUIT
Q240
Q1
61
62
63
33(ANODE DRIVER)
10
SL1
SL2
SL135
SL136
DL240
DL239
DL2
DL1
21R (CATHODE DRIVER)
21L (CATHODE DRIVER)
41
42
43
44
43-1
43-2
43-135
43-136
Q1
Q2
Q135
Q136
45
46
47
48
BK_ODD
BK_EVEN
FR(L)
FR(H)
SK
LAT
BKa
BKb

| FR | BK_ODD | BK_EVEN |
|---|---|---|
| H(1) | BKb | BKa |
| L(0) | BKa | BKb |

DISPLAY DEVICE AND SCANNING LINE DRIVER

FIELD OF THE INVENTION

The present invention relates to a display device and a scanning line driver used in the display device.

BACKGROUND OF THE INVENTION

Conventionally, there has been known a display panel for displaying an image by using an organic light emitting diode (OLED), a display device using a liquid crystal display (LCD), a display device using a vacuum fluorescent display (VFD), a display device using a field emission display (FED) or the like.

In many display devices, there is provided a display unit in which data lines connected in common to a plurality of pixels arranged in the column direction and scanning lines connected in common to a plurality of pixels arranged in the row direction are arranged in a matrix.

Japanese Patent Application Publication No. H02-000088 discloses a display device in which, in order to prevent image quality from lowering due to the resistance and the capacitance between the drive terminal of the electrode and the leading end of the scanning line or the data line with an increase in size of a liquid crystal panel, each of data lines or scanning lines is driven from both ends thereof by separate drive circuits.

Japanese Patent Application Publication No. 2004-325879 discloses a technology in which scanning lines are divided into two or more groups of scanning lines to cope with an increase in the charge and discharge current upon reset or preset with an increase in size of a display area.

Japanese Patent Application Publication No. H08-129360 discloses that overlapping of selection periods of adjacent selection signals is eliminated using a mask signal.

As disclosed in Japanese Patent Application Publication No. H02-000088, it is possible to improve the display quality by driving each of, e.g., the scanning lines from both ends thereof by separate scanning line drivers.

Particularly, in such a case, since the same scanning line drivers can be employed as two scanning line drivers, it is advantageous in terms of manufacturing cost, improvement of component efficiency and the like.

Further, in this case, the wiring between the scanning lines and the scanning line drivers is configured such that a first to an m-th output terminals of one scanning line driver are respectively connected to the scanning lines to perform scanning in the direction from the first scanning line to the m-th scanning line, and a first to an m-th output terminals of the other scanning line driver are respectively connected to the scanning lines to perform scanning in the direction from m-th scanning line to the first scanning line (m corresponds to the number of the scanning lines). Specifically, when driving the first scanning line (the scanning line for pixels of the first horizontal line), one scanning line driver outputs a scanning signal from the first output terminal to select the first scanning line, and at the same time, the other scanning line driver outputs a scanning signal from the m-th output terminal to select the first scanning line. Accordingly, the first scanning line is selected from both ends thereof at the same time.

At this moment, both scanning line drivers are requested to output the same scanning signals to select the first scanning line. However, the levels of the scanning signals may be different from each other due to conditions of blanking periods included in the scanning signals. Accordingly, an appropriate scanning signal may not be applied, which leads to undesirable phenomena such as noise and heat generation.

SUMMARY OF THE INVENTION

In view of the above, the present invention provides a display device capable of driving a scanning line from both ends thereof with an appropriate scanning signal even when using the same scanning line drive units (scanning line driver).

In accordance with an aspect of the present invention, there is provided a display device including: a display unit in which data lines connected in common to a plurality of pixels arranged in a column direction and m scanning lines connected in common to a plurality of pixels arranged in a row direction are arranged in a matrix; a data line drive unit for applying a signal corresponding to display data to each of the data lines; a first scanning line drive unit for applying a scanning signal to one end of each of the scanning lines; and a second scanning line drive unit for applying a scanning signal to the other end of each of the scanning lines. When m is an even value, the first scanning line drive unit has a first to a m-th output terminals connected respectively to the first to the m-th scanning lines and performs a forward direction scanning signal output to sequentially select the scanning lines in the order from the first output terminal to the m-th output terminal. Further, the second scanning line drive unit has a m-th to a first output terminals connected respectively to the first to the m-th scanning lines and, in synchronization with the first scanning line drive unit, performs a reverse direction scanning signal output to sequentially select the scanning lines in the order from the m-th output terminal to the first output terminal. Furthermore, the first scanning line drive unit outputs scanning signals having a first blanking period from the odd-numbered output terminals, and outputs scanning signals having a second blanking period from the even-numbered output terminals, the second blanking period being shifted from the first blanking period, and the second scanning line drive unit outputs scanning signals having the second blanking period from the odd-numbered output terminals, and outputs scanning signals having the first blanking period from the even-numbered output terminals.

With the above configuration, the first and the second scanning line drive unit output scanning signals respectively in the forward direction and in the reverse direction to drive each of the scanning lines. The scanning signals are simultaneously inputted to both ends of the respective scanning lines to thereby select the corresponding scanning line. The scanning signals outputted from even-numbered output terminals and from odd-numbered output terminals include different blanking periods (first and second blanking period) from each other.

If m is an even number, each of the scanning lines has one end connected to the even-numbered output terminal of one scanning line drive unit and the other end connected to the odd-numbered output terminal of the other scanning line drive unit, and is simultaneously driven from both ends by both scanning line drive units. In this case, when the blanking periods are shifted, a period for which the scanning signals different in potential from each other are applied may occur. With the configuration of the present invention, this can be prevented from occurring by switching the odd-numbered and the even-numbered output terminals to which the first and the second blanking period are applied by each of the scanning line drive units.

Further, each of the first scanning line drive unit and the second scanning line drive unit may include a first selector configured to select and add one of a first blanking signal defining the first blanking period and a second blanking signal defining the second blanking period to the scanning signals to be outputted from the odd-numbered output terminals, and a second selector configured to select and add the other one of the first blanking signal and the second blanking signal to the scanning signals to be outputted from the even-numbered output terminals.

By the first and the second selector, the output terminals to which the first and the second blanking signal are applied can be switched.

Preferably, one of the first scanning line drive unit and the second scanning line drive unit performs the forward direction scanning signal output and the other one of the first scanning line drive unit and the second scanning line drive unit performs the reverse direction scanning signal output according to a scanning direction control signal, and the first and the second selector may be configured to select the first blanking signal or the second blanking signal according to the scanning direction control signal.

With the above configuration, since the output terminals to which the first and the second blanking signal are outputted are set according to whether the forward direction scanning signal output or the reverse direction scanning signal output is performed, it is possible to apply the same blanking periods to each of the scanning lines.

In accordance with another aspect of the present invention, there is provided a scanning line driver for applying scanning signals to m scanning lines of a display unit in which data lines connected in common to a plurality of pixels arranged in a column direction and the scanning lines connected in common to a plurality of pixels arranged in a row direction are arranged in a matrix, the scanning line driver including: a scanning signal output unit, which has m output terminals respectively connected to the m scanning lines, configured to, when m is an even number, selectively perform a forward direction scanning signal output to sequentially select the scanning lines in the order from the first to the m-th output terminals, or a reverse direction scanning signal output to sequentially select the scanning lines in the order from the m-th to the first output terminals; a first selector configured to select and add one of a first blanking signal defining a first blanking period to be included in the scanning signals and a second blanking signal defining a second blanking period to be included in the scanning signals to the scanning signals to be outputted from the odd-numbered output terminals, the second blanking period being shifted in timing from the first blanking period; and a second selector configured to select and add the other one of the first blanking signal and the second blanking signal to the scanning signals to be outputted from the even-numbered output terminals.

With this configuration, it is possible to switch between the even-numbered output terminals and the odd-numbered output terminals to which the first and the second blanking signal is applied.

The first and the second selector may select the first blanking signal or the second blanking signal according to whether the scanning signal output unit performs the forward direction scanning signal output or the reverse direction scanning signal output.

By the first and the second selector, it is possible to set the output terminals to which the first and the second blanking signal are outputted according to whether the forward direction scanning signal output or the reverse direction scanning signal output is performed.

According to the present invention, it is possible to realize a display device capable of driving each of the scanning lines from both ends thereof without outputting an inappropriate scanning signal and operating stably even if using the same scanning line drive unit. As a result, it is possible to improve the manufacturing efficiency and promote the cost reduction.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, the present invention will be described in detail with reference to the accompanying drawings which form a part hereof.

First Embodiment

Figure 1:
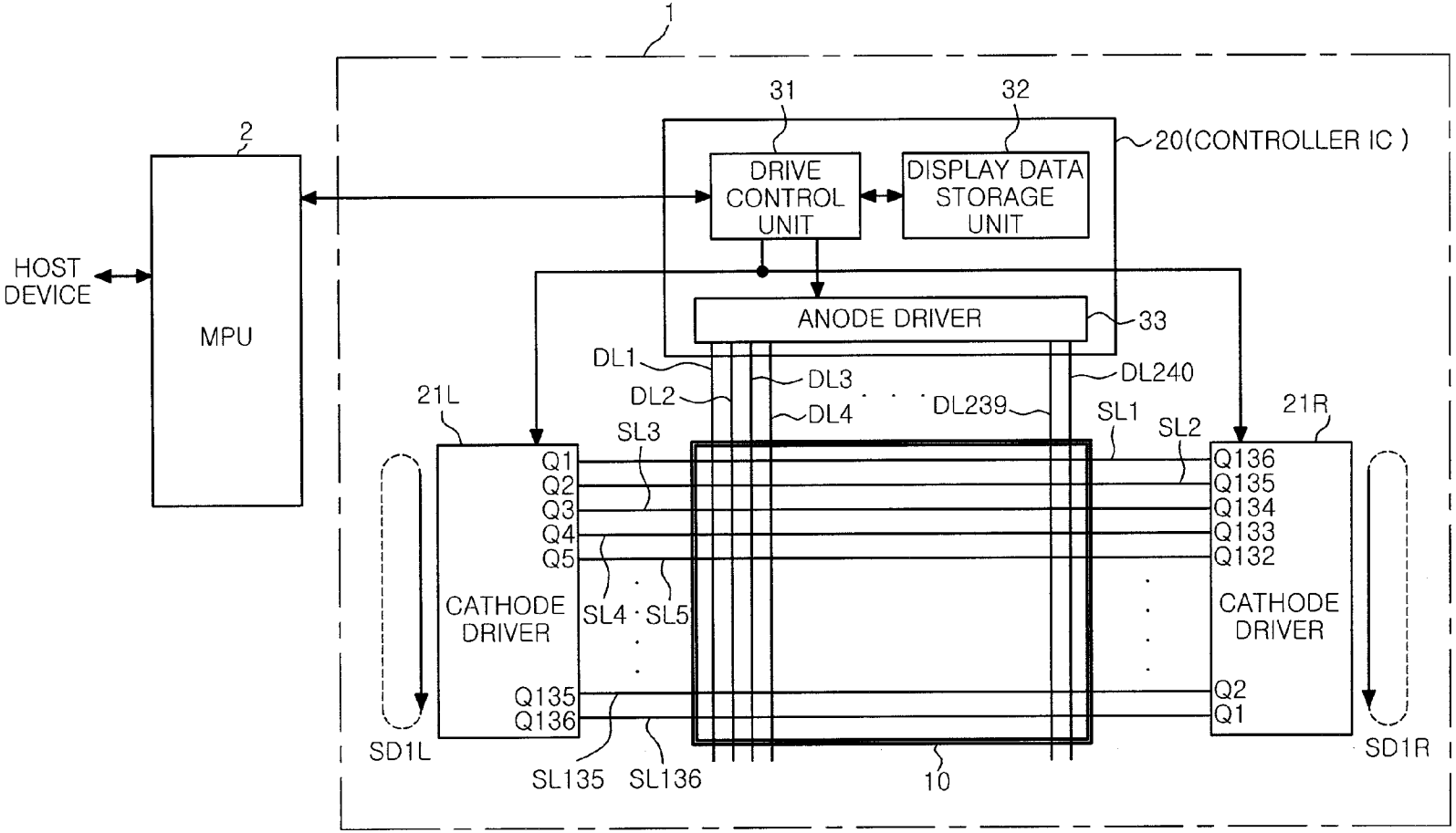
FIG. 1 is a block diagram of a display device in accordance with a first embodiment of the present invention.

FIG. 1 shows a display device 1 in accordance with a first embodiment of the present embodiment and a micro processing unit (MPU) (arithmetic unit) 2 for controlling operation of the display device 1. The display device 1 includes a display unit 10 serving as a display screen, a controller integrated circuit (IC) 20, and cathode drivers 21L and 21R. Herein, each of the cathode drivers 21L and 21R corresponds to a scanning line driver defined in the claims.

The display unit 10 includes, e.g., 240 dots arranged in the horizontal direction and, e.g., 136 dots arranged in the vertical direction. Thus, the display unit 10 has 32640 (=240×136) dots as effective pixels, thereby forming a display image. In the present embodiment, each dot is formed by a self-emitting element using an OLED.

For these dots, display data lines DL (DL1 to DL240) and scanning lines SL (SL1 to SL136) are disposed. Specifically, each of 240 display data lines DL1 to DL240 is connected in common to 136 dots arranged in a column direction (vertical direction) of the display unit 10. Further, each of 136 scanning lines SL1 to SL136 is connected in common to 240 dots arranged in a row direction (horizontal direction). By applying respectively display data signals (luminance signals) from the display data lines DL to 240 dots connected to a scanning line selected among the scanning lines SL, each dot of the corresponding scanning line is driven to emit light with a luminance corresponding to the display data signal.

For driving of the display unit 10, the controller IC 20 and the cathode drivers 21L and 21R are provided. The controller IC 20 has a drive control unit 31, a display data storage unit 32, and an anode driver 33. The anode driver 33 outputs display data signals (luminance signals) to the display data lines DL1 to DL240. That is, the anode driver 33 serves as a data line driver.

The drive control unit 31 communicates display data and commands with the MPU 2 and controls a display operation according to the commands. For example, upon receiving a display start command, the drive control unit 31 performs timing setting to start scanning of the scanning lines SL by the cathode drivers 21L and 21R. Also, the drive control unit 31 controls the anode driver 33 to start outputting of the display data signals for the 240 display data lines DL in synchronization with the scanning of the scanning lines SL by the cathode drivers 21L and 21R.

Further, the drive control unit 31 stores the display data received from the MPU 2 in the display data storage unit 32 and supplies the display data signals to the anode driver 33 in synchronization with the scanning timing. By this control, each dot of the selected line, i.e., one scanning line SL to which a scanning signal of a selection level is applied, is driven to emit light. The respective lines are driven to emit light in sequence, and a frame image is displayed.

In the present embodiment, two cathode drivers 21L and 21R are disposed on opposite sides of the display unit 10. The cathode driver 21L functions as a scanning line driver for applying a scanning signal to one end of the scanning line SL. The cathode driver 21R functions as a scanning line driver for applying a scanning signal to the other end of the scanning line SL.

The cathode driver 21L is connected to the scanning lines SL1 to SL136 through output terminals Q1 to Q136 thereof, respectively. By sequentially outputting scanning signals of the selection level from the output terminal Q1 to the output terminal Q136 in a scanning direction SD1L as illustrated in FIG. 1, scanning is performed such that the scanning lines SL1 to SL136 are selected sequentially. In the following description, sequentially outputting scanning signals of the selection level from the output terminal Q1 to the output terminal Q136 is referred to as a "forward direction scanning signal output."

The cathode driver 21R is connected to the scanning lines SL1 to SL136 through output terminals Q136 to Q1, respectively. By sequentially outputting scanning signals of the selection level from the output terminal Q136 to the output terminal Q1 in a scanning direction SD1R as illustrated, scanning is performed such that the scanning lines SL1 to SL136 are selected sequentially. In the following description, sequentially outputting scanning signals of the selection level from the output terminal Q136 to the output terminal Q1 is referred to as a "reverse direction scanning signal output".

Thus, the cathode driver 21L performs the forward direction scanning signal output and the cathode driver 21R performs the reverse direction scanning signal output. However, when viewed from the scanning lines SL, the scanning lines SL1 to SL136 are sequentially selected.

Specifically, at the selection timing of the scanning line SL1, the scanning signals of the selection level are simultaneously outputted from the output terminal Q1 of the cathode driver 21L and the output terminal Q136 of the cathode driver 21R. Then, at the selection timing of the scanning line SL2, the scanning signals of the selection level are simultaneously outputted from the output terminal Q2 of the cathode driver 21L and the output terminal Q135 of the cathode driver 21R.

In this way, the scanning signals are simultaneously applied to both ends of each of the scanning lines SL1 to SL136 so that the scanning lines SL1 to SL136 are sequentially selected. The cathode driver 21R outputs scanning signals in the reverse direction of that of the cathode driver 21L because the connection relationship between the scanning lines SL1 to SL136 and the output terminals Q1 to Q136 of the cathode driver 21R is opposite to that of the cathode driver 21L. This will be in more detail described later with reference to FIG. 8.

Figure 2:
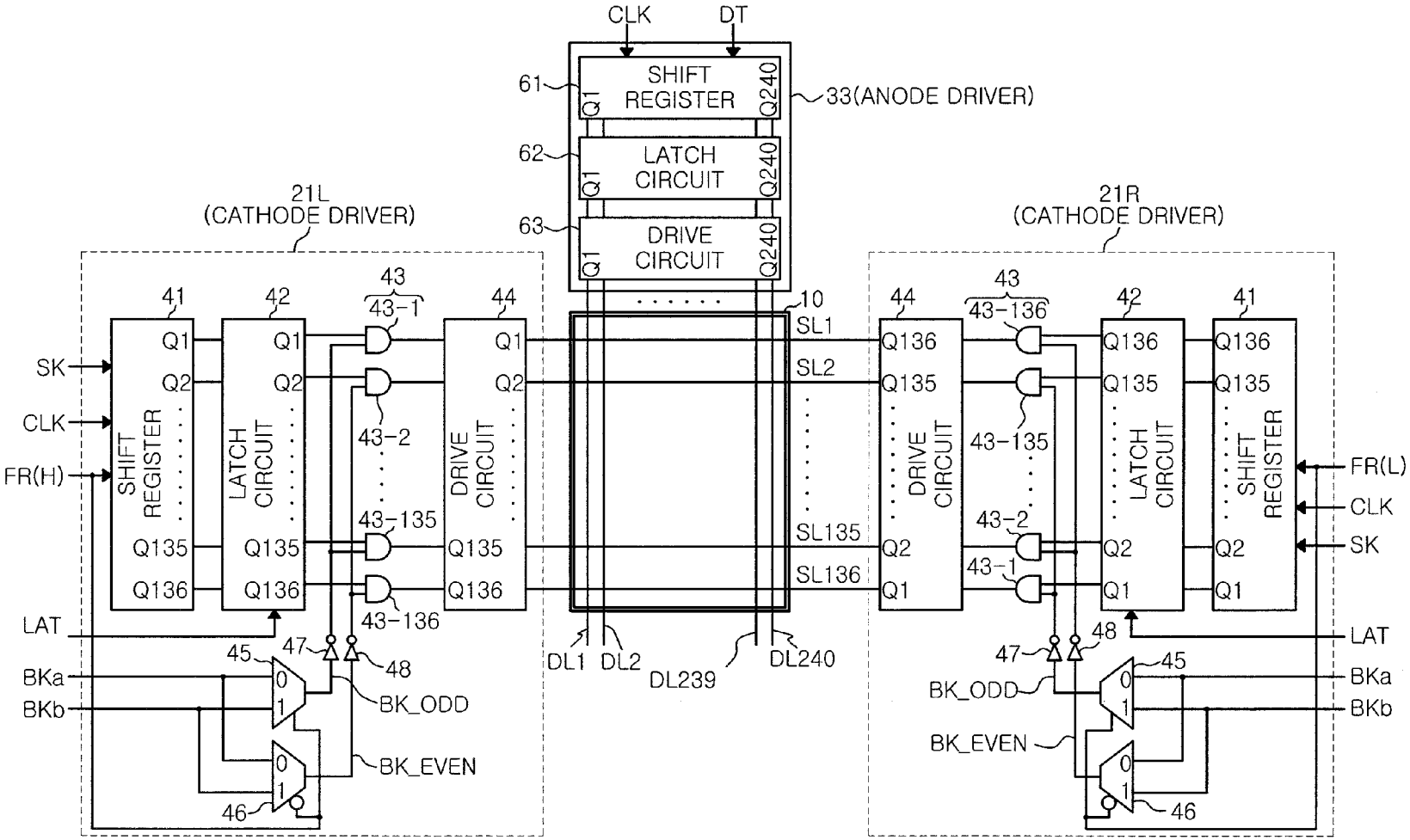
FIG. 2 is a block diagram of a driving system of the first embodiment.

FIG. 2 shows in more detail the cathode drivers 21L and 21R, the anode driver 33 and the display unit 10 shown in FIG. 1.

The anode driver 33 includes a shift register 61, a latch circuit 62 and a drive circuit 63. When performing display, clock signals CLK and a display data signals DT are supplied to the anode driver 33 from the drive control unit 31 of the controller IC 20 shown in FIG. 1.

The shift register 61 takes the display data signals DT using the clock signals CLK to obtain sequential outputs Q1 to Q240 corresponding to the display data lines DL1 to DL240. The outputs Q1 to Q240 of the shift register 61, i.e., the display data signals DT for one line, are latched by the latch circuit 62, and transmitted to the drive circuit 63 as outputs Q1 to Q240 of the latch circuit 62. The drive circuit 63 has output terminals for the outputs Q1 to Q240 which are connected to the display data lines DL1 to DL240, respectively. With this configuration, the display data signals DT for each line are outputted to the corresponding one of the display data lines DL1 to DL240.

The cathode drivers 21L and 21R have the same configuration, and each of the cathode drivers 21L and 21R includes a shift register 41, a latch circuit 42, AND gates 43 (43-1 to 43-136), a drive circuit 44, a first selector 45, a second selector 46, and inverters 47 and 48. The drive control unit 31 of the controller IC 20 supplies each of the cathode drivers 21L and 21R with a scanning signal SK, a clock signal CLK, a scanning direction control signal FR, a latch signal LAT and blanking signals BKa and BKb.

For example, the scanning signal SK is an instruction signal for frame scanning timing. The shift register 41 obtains outputs Q1 to Q136 corresponding to the respective scanning lines SL1 to SL136 by sequentially transmitting a signal of the selection level based on the scanning signal SK. In the present embodiment, the shift register 41 is configured such that the transmission direction thereof is set based on the scanning direction control signal FR. The shift register 41 of the cathode driver 21L performs data transmission in the order from the terminal Q1 to the terminal Q136. This is data transmission for performing the forward direction scanning signal output. On the other hand, the shift register 41 of the cathode driver 21R performs data transmission in the order from the terminal Q136 to the terminal Q1, i.e., data transmission for performing the reverse direction scanning signal output.

Figure 3A:
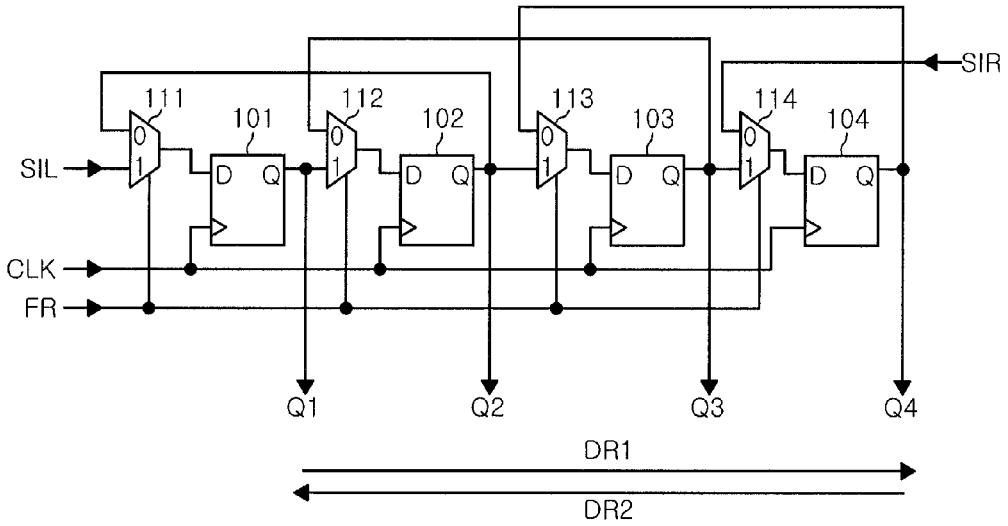
FIGS. 3A and 3B are views for explaining operation of a shift register in the display device of the first embodiment.

A configuration of the shift register 41 in which the transmission direction is controlled by the scanning direction control signal FR will be described with reference to FIG. 3A. FIG. 3A shows a model of the shift register in which the number of shift stages is 4. In FIG. 3A, a signal SIL is an input signal in the case of shifting from the left to the right in the figure, and a signal SIR is an input signal in the case of shifting from the right to the left in the figure.

As shown in the model of FIG. 3A, D flip-flops 101, 102, 103 and 104 receive Q outputs of their previous stages through respective selectors 111, 112, 113 and 114 as D inputs, and latch them in synchronization with the clock signal CLK. The transmission data or the input data from the D flip-flop on the left side in the figure is supplied to input terminal 1 of each of the selectors 111, 112, 113 and 114, and the transmission data or the input data from the D flip-flop on the right side in the figure is supplied to input terminal 0 of each of the selectors 111, 112, 113 and 114. Then, each of the selectors 111, 112, 113 and 114 selects the input terminal 1 or the input terminal 0 according to the scanning direction control signal FR and outputs a signal from the selected input terminal 1 or 0.

For example, if the scanning direction control signal FR has an H level, each of the selectors 111, 112, 113 and 114 selects the input terminal 1. Thus, the signal SIL is sequentially transmitted to the D flip-flops 101, 102, 103 and 104 in the transmission direction DR1, and outputs Q1 to Q4 are obtained during the transmission. Further, if the scanning direction control signal FR has an L level, each of the selectors 111, 112, 113 and 114 selects the input terminal 0. In this case, the signal SIR is sequentially transmitted to the D flip-flops 104, 103, 102 and 101 in the transmission direction DR2, and outputs Q4 to Q1 are obtained during the transmission.

Figure 3B:
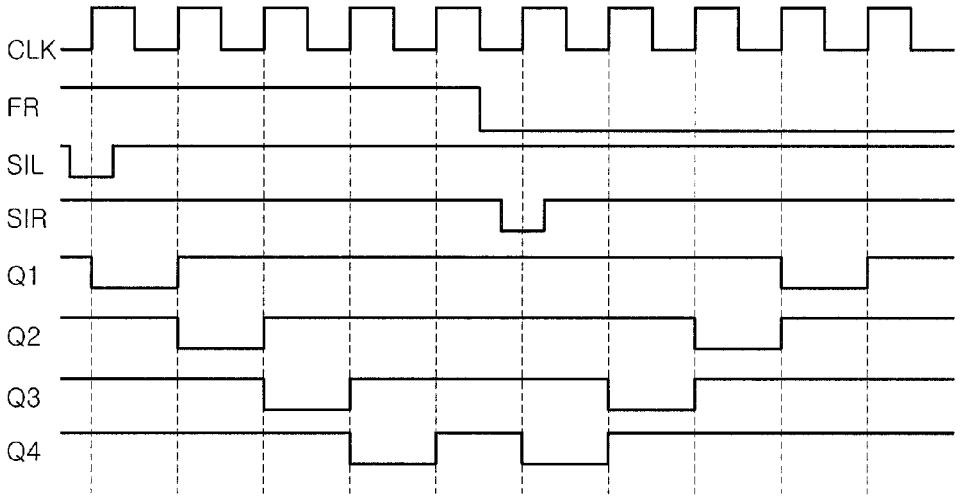

FIG. 3B shows a period during which the scanning direction control signal FR has the H level and a period during which the scanning direction control signal FR has the L level. During the period in which the scanning direction control signal FR is of the H level, the input signal SIL is latched by the D flip-flop 101 and reflected to the output Q1, and then sequentially transmitted. Accordingly, the level (L level in this example) of the input signal SIL is reflected to the sequential outputs Q2, Q3 and Q4. On the other hand, during the period in which the scanning direction control signal FR is of the L level, the input signal SIR is latched by the D flip-flop 104 and reflected to the output Q4, and then sequentially transmitted. Accordingly, the L level of the input signal SIR is reflected to the sequential outputs Q3, Q2 and Q1.

The shift register 41 of FIG. 2 is configured, e.g., as shown in FIG. 3A, except that the number of shift stages is 136. Data shift in the forward or the reverse direction is performed depending on the scanning direction control signal FR. A signal of the H level (e.g., a signal indicating the forward direction scanning signal output) is inputted as the scanning direction control signal FR to the cathode driver 21L. Accordingly, the shift register 41 of the cathode driver 21L performs shifts in the forward direction (in the direction of Q1→Q2→ . . . →Q136) to obtain the outputs Q1 to Q136.

On the other hand, a signal of the L level (e.g., a signal indicating the reverse direction scanning signal output) is inputted as the scanning direction control signal FR to the cathode driver 21R. In this case, the shift register 41 of the cathode driver 21R performs a shift in the reverse direction (in the direction of Q136→Q135→ . . . →Q1) to obtain outputs Q136 to Q1.

As shown in FIG. 2, in the cathode driver 21L, the outputs Q1 to Q136 of the shift register 41 are latched by the latch circuit 42. Then, outputs Q1 to Q136 of the latch circuit 42 are supplied to the drive circuit 44 through the AND gates 43 (43-1 to 43-136). Outputs Q1 to Q136 of the drive circuit 44 correspond to the outputs of the output terminals Q1 to Q136 of the cathode driver 21L shown in FIG. 1. That is, the outputs Q1 to Q136 of the drive circuit 44 are applied as scanning signals to the scanning lines SL1 to SL136.

Similarly, in the cathode driver 21R, the outputs Q1 to Q136 of the shift register 41 are latched by the latch circuit 42. Then, outputs Q1 to Q136 of the latch circuit 42 are supplied to the drive circuit 44 through AND gates 43 (43-1 to 43-136). Outputs Q1 to Q136 of the drive circuit 44 correspond to the outputs of the output terminals Q1 to Q136 of the cathode driver 21R shown in FIG. 1. Then, the outputs Q1 to Q136 of the drive circuit 44 are applied as scanning signals to the scanning lines SL136 to SL1.

Figures 4A, 4B:
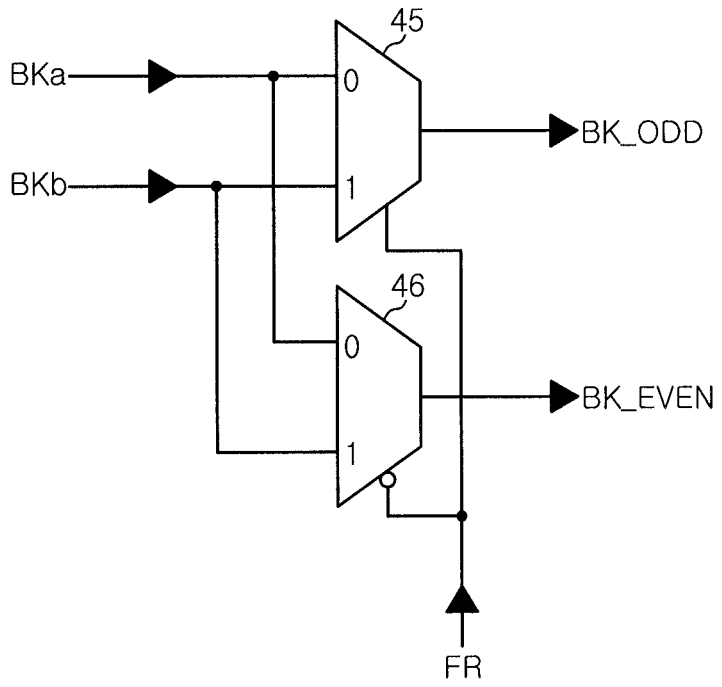
FIGS. 4A and 4B are views for explaining operation of a selector in the display device of the first embodiment.

In each of the cathode drivers 21L and 21R, a signal BK_ODD outputted from the selector 45 is inputted to the odd-numbered AND gates 43 (43-1, 43-3, . . . , 43-135) through the inverter 47. Further, a signal BK_EVEN outputted from the selector 46 is inputted to the even-numbered AND gates 43 (43-2, 43-4, . . . , 43-136) through the inverter 48. The blanking signal BKa is inputted to the input terminal 0 of each of the selectors 45 and 46, and the blanking signal BKb is inputted to the input terminal 1 of each of the selectors 45 and 46. FIG. 4A shows an enlarged view of the selectors 45 and 46.

Each of the selectors 45 and 46 selects the input according to the scanning direction control signal FR. The scanning direction control signal FR is inputted as it is to the selector 45 as a selection control signal, whereas the scanning direction control signal FR is inverted and inputted as a selection control signal to the selector 46. Further, each of the selectors 45 and 46 selects the input terminal 1 if the selection control signal has the H level, and selects the input terminal 0 if the selection control signal has the L level. Therefore, each of the selectors 45 and 46 performs selection as shown in FIG. 4B.

When the scanning direction control signal FR has the H level, the selector 45 selects the input terminal 1, and the selector 46 selects the input terminal 0. Accordingly, the output signal BK_ODD of the selector 45 is the blanking signal BKb, and the output signal BK_EVEN of the selector 46 is the blanking signal BKa. When the scanning direction control signal FR has the L level, the selector 45 selects the input terminal 0, and the selector 46 selects the input terminal 1. Accordingly, the output signal BK_ODD of the selector 45 is the blanking signal BKa, and the output signal BK_EVEN of the selector 46 is the blanking signal BKb.

Hereinafter, the operation of the cathode driver 21L will be described as an example with reference to FIG. 5.

Figure 5:
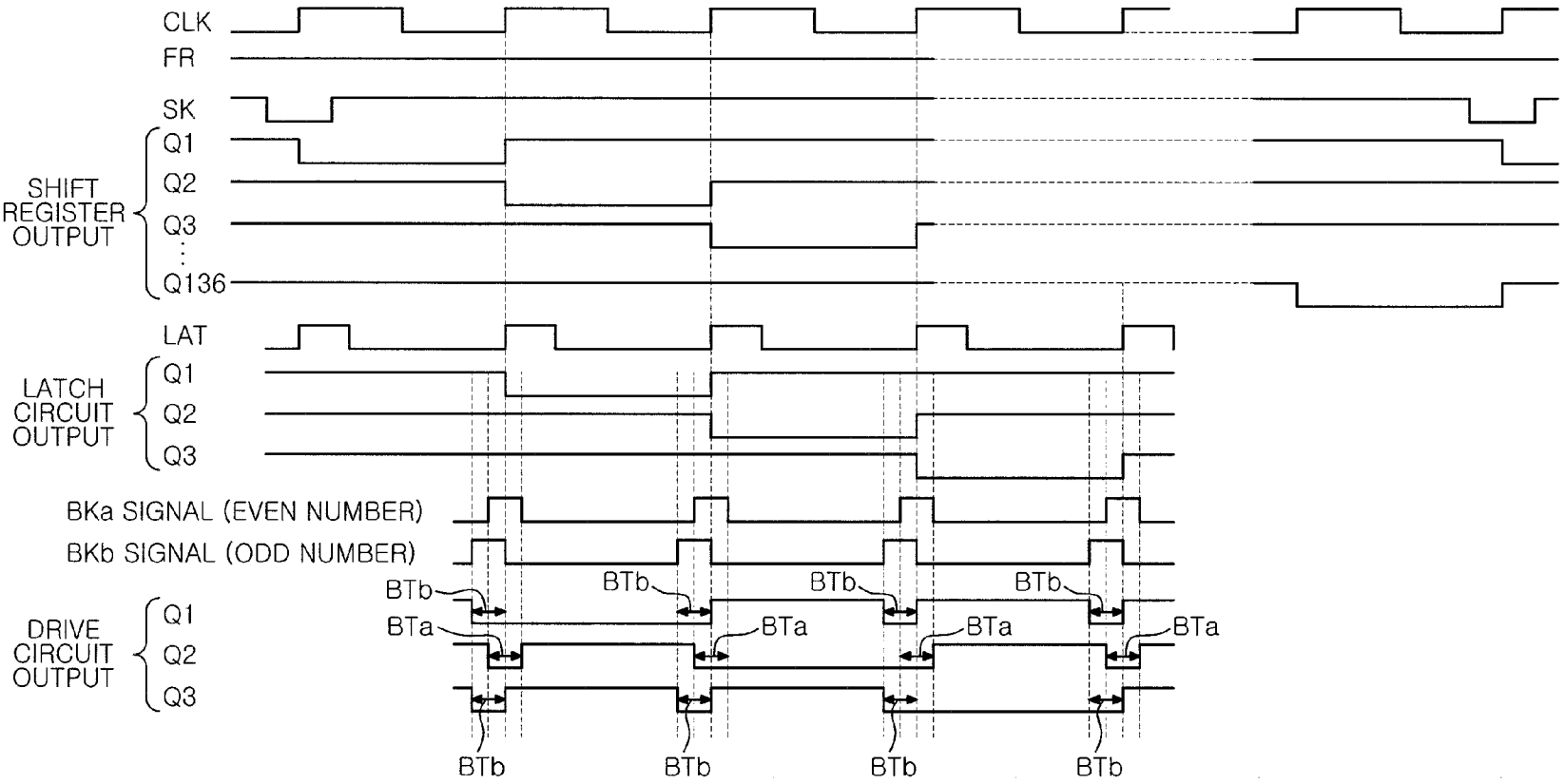
FIG. 5 is a view for explaining operation of a cathode driver in the display device of the first embodiment.

As shown in FIG. 5, the clock signal CLK, the scanning direction control signal FR of the H level and the scanning signal SK are inputted to the shift register 41 of the cathode driver 21L. The shift register 41 receives the scanning signal SK, and performs shift in the above-described forward direction (in the direction of Q1→Q2→ . . . →Q136). Thus, as shown in FIG. 5, the outputs Q1 to Q136 of the shift register 41 are obtained. The outputs Q1 to Q136 of the shift register 41 are latched by the latch circuit 42 in synchronization with the latch signal LAT, and outputs Q1 to Q136 of the latch circuit 42 are obtained as illustrated (only the latch circuit outputs Q1, Q2 and Q3 are shown in FIG. 5).

The outputs of the latch circuit 42 are supplied to the AND gates 43. In the case of the cathode driver 21L, since the scanning direction control signal FR has the H level, the output signal BK_ODD of the selector 45 is the blanking signal BKb. Thus, the blanking signal BKb is inverted by the inverter 47 and supplied to the odd-numbered AND gates 43-1, 43-3, . . . , 43-135, and logical products between the inverted blanking signal BKb and the latch circuit outputs Q1, Q3, . . . , Q135 are obtained.

On the other hand, the output BK_EVEN of the selector 46 becomes the blanking signal BKa. Thus, the blanking signal BKa is inverted by the inverter 48 and supplied to the even-numbered AND gates 43-2, 43-4, . . . , 43-136, and logical products between the inverted blanking signal BKa and the latch circuit outputs Q2, Q4, . . . , Q136 are obtained. Then, in response to the outputs of the AND gates 43, the illustrated drive circuit outputs Q1 to Q136 (only the drive circuit outputs Q1, Q2 and Q3 are shown in FIG. 5) are outputted as scanning signals to the scanning lines SL1 to SL136, respectively.

The scanning signals are outputted to the scanning lines SL1 to SL136 from the output terminals Q1 to Q136 of the drive circuit 44, respectively, and one of the scanning lines Q1 to Q136 to which the scanning signal of the L level is outputted is selected. Thus, in the example of FIG. 5, as the drive circuit outputs Q1, Q2, Q3 sequentially become the L level, the scanning lines SL1, SL2, SL3 are sequentially selected. That is, the cathode driver 21L performs the forward direction scanning signal output such that scanning is performed in the direction from the scanning line SL1 to the scanning line SL136.

In the present embodiment, the blanking signal BKb or the blanking signal BKa is inverted and inputted to each of the AND gates 43. Accordingly, a blanking period BTa or blanking period BTb is added to the drive circuit outputs Q1 to Q136 (scanning signals) as illustrated. The blanking period BTa is defined by the blanking signal BKa and the blanking period BTb is defined by the blanking signal BKb. The blanking period BTa and the blanking period BTb are added to the scanning signals for even-numbered scanning lines and for odd-numbered scanning lines, respectively, at different timings. In the present embodiment, the blanking signal BKa is shifted from the blanking signal BKb by a half of a duration thereof, so the blanking period BTa is shifted from the blanking period BTb by a half of the duration.

Although the operation of the cathode driver 21L has been described, the cathode driver 21R also has substantially the same operation. In the cathode driver 21R, the shift register 41 performs shift in the reverse direction (in the direction of Q136→Q135→ . . . →Q1) in response to the scanning direction control signal FR of the L level.

Further, by the scanning direction control signal FR of the L level, the outputs of the selectors 45 and 46 of the cathode driver 21R become opposite to those of the selectors 45 and 46 of the cathode driver 21L. Specifically, the blanking signal BKa becomes the output BK_ODD of the selector 45. Thus, the blanking signal BKa is inverted by the inverter 47 and supplied to the odd-numbered AND gates 43-1, 43-3, . . . , 43-135, and logical products between the inverted blanking signal BKa and the latch circuit outputs Q1, Q3, . . . , Q135 are obtained.

Further, the blanking signal BKb becomes the output BK_EVEN of the selector 46. Thus, the blanking signal BKb is inverted by the inverter 48 and supplied to the even-numbered AND gates 43-2, 43-4, . . . , 43-136, and logical products between the inverted blanking signal BKb and the latch circuit outputs Q2, Q4, . . . , Q136 are obtained.

Accordingly, as the operation waveforms of the cathode driver 21R, the shift register outputs Q1, Q2, Q3 . . . Q136 shown in FIG. 5 may respectively correspond to the shift register outputs Q136, Q135, Q134 . . . Q1 of the cathode driver 21R. Thus, the latch circuit outputs Q1, Q2, Q3 of FIG. 5 may respectively correspond to the latch circuit outputs Q136, Q135, Q134 of the cathode driver 21R. Further, the drive circuit outputs Q1, Q2, Q3 of FIG. 5 may respectively correspond to the drive circuit outputs Q136, Q135, Q134 of the cathode driver 21R.

As a result, the same scanning signal is applied to both ends of each of the scanning lines SL1 to SL136 by the cathode drivers 21L and 21R. Further, the drive control unit 31 supplies simultaneously the scanning signal SK, the clock signal CLK and the latch signal LAT in common to the cathode drivers 21L and 21R, and the scanning signals are synchronously outputted to the scanning lines SL.

Hereinafter, description will be made on operations and effects of the present embodiment.

Figure 6:
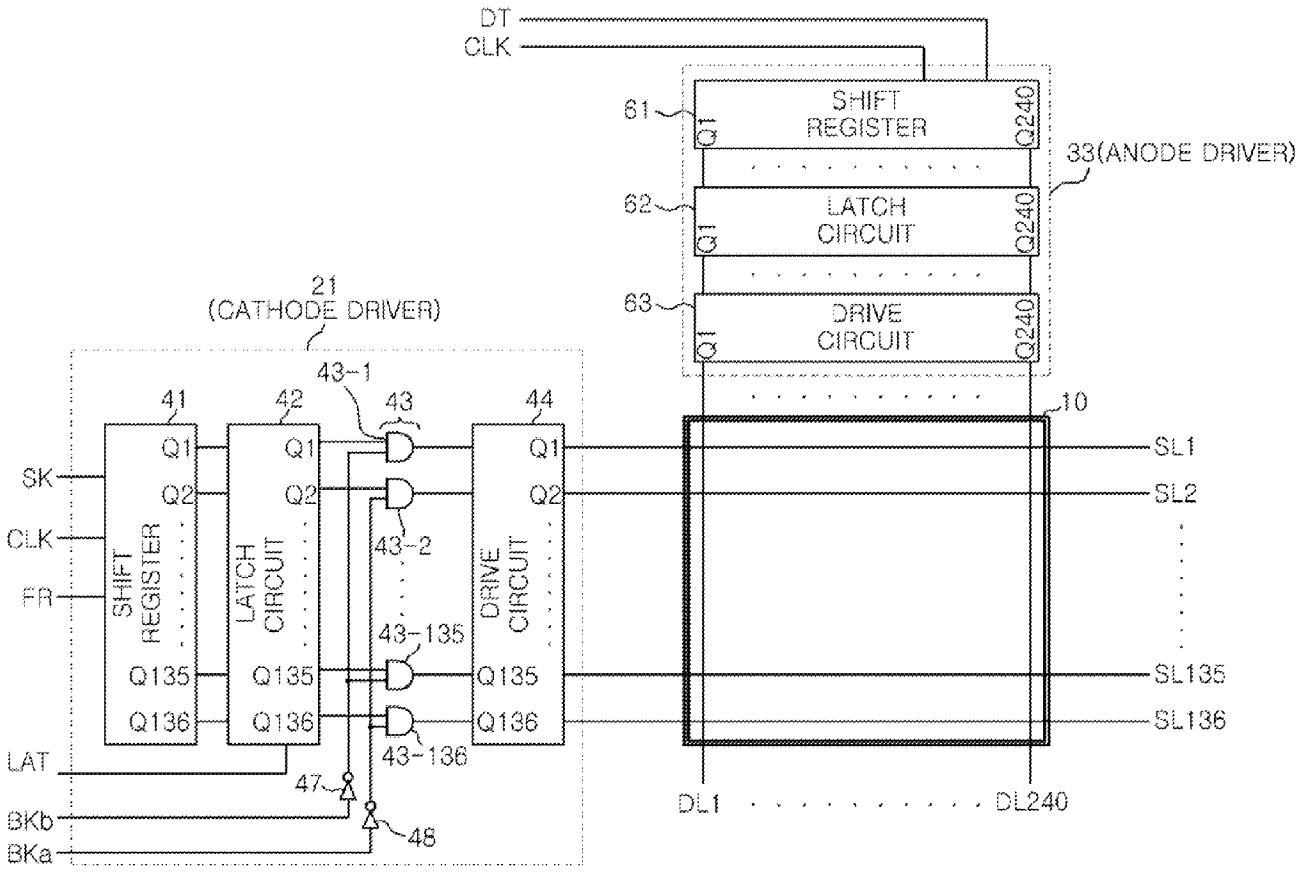
FIG. 6 (RELATED ART)
FIG. 6 is a view for explaining a conventional configuration in which selectors are not provided as a comparative example.

As a comparative example, FIG. 6 shows a conventional configuration in which the scanning lines SL1 to SL136 are driven using one driver 21 unlike the above-described embodiment. In the configuration of FIG. 6, the same reference numerals are given to the same parts as those of FIG. 2 and a description thereof will be omitted. The blanking signals BKb and BKa are supplied as it is to the AND gates 43 through the inverters 47 and 48, respectively, without providing the selectors 45 and 46. The blanking signal BKa is inverted by the inverter 48 and supplied to the even-numbered AND gates 43-2, 43-4, . . . , 43-136. Similarly, the blanking signal BKb is inverted by the inverter 47 and supplied to the odd-numbered AND gates 43-1, 43-3, . . . , 43-135.

First, shifting the blanking periods between the odd-numbered scanning lines and even-numbered scanning lines by using the blanking signals BKb and BKa will be described. In case of driving of a so-called cathode-reset method, a blanking period is provided in the respective scanning signals as a period for which makes the respective scanning lines the L level between the selection timing of one scanning line and the selection timing of the next scanning line.

Figure 7A:
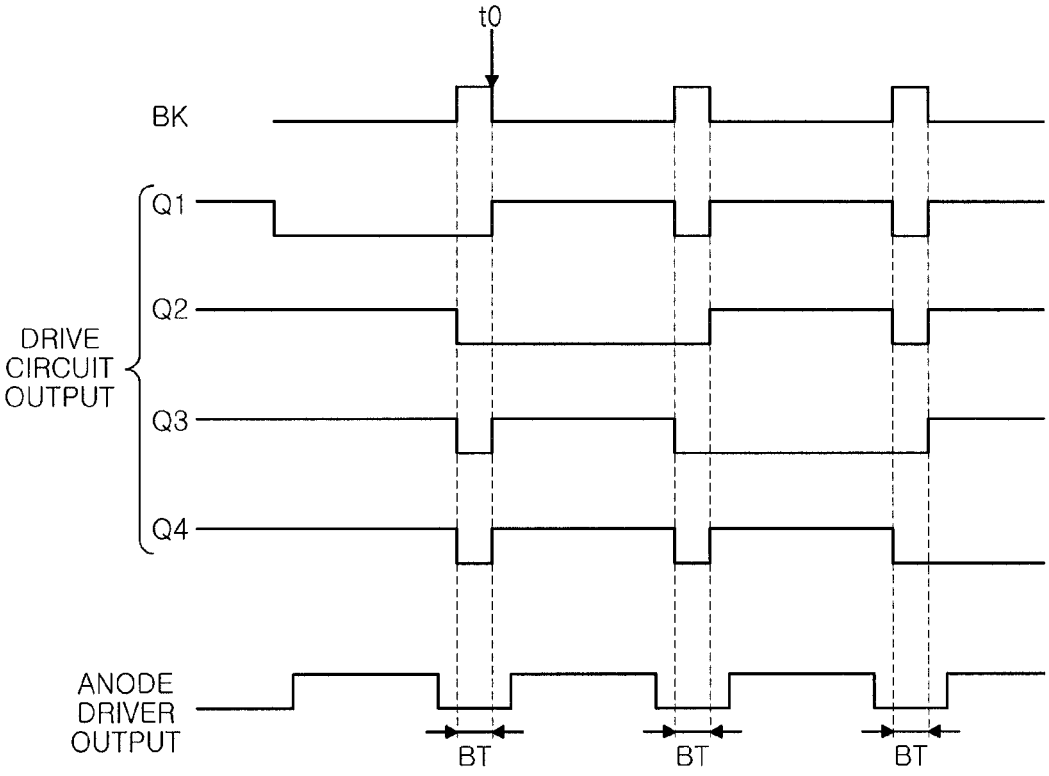
FIG. 7A (RELATED ART)
FIGS. 7A and 7B are views for explaining outputs of driver circuits and cathode drivers in the conventional configuration.

FIG. 7A shows scanning signals (drive circuit outputs Q1, Q2, Q3, Q4 . . . ) in the case where the blanking periods are not shifted. Specifically, by providing a common blanking signal BK to the scanning signals for the respective scanning lines, the blanking periods BT are added to the scanning signals of the scanning lines SL. Accordingly, for the blanking period BT, the respective scanning lines become the L level simultaneously.

A waveform of a display data output (anode driver output) from the anode driver 33 is illustrated in FIG. 7A. The blanking period BT falls into a period for which the display data signal is not outputted from the anode driver 33. Thus, the application of the blanking period does not directly affect the corresponding display image.

By providing the blanking period BT as described above, the other scanning lines than one selected scanning line (L level) become the H level simultaneously at the end of the blanking period BT. For example, at time point t0 of FIG. 7A when the scanning line SL2 is selected, the scanning signal Q2 for the scanning line SL2 continues to have the L level, and the other scanning signals, i.e., the drive circuit outputs Q1, Q3 to Q136 rise up to the H level at the same time.

Accordingly, it is possible to improve the rising of the display data signals applied to the display data lines DL1 to DL240 from the anode driver 33. The drive circuit 63 of the anode driver 33 is a constant current driver having a problem that the rising of the display data signal is poor. By raising the scanning signals that are non-selected lines to the H level at the end of the blanking period, it is possible to improve the rising of the display data signal and the display response of each pixel.

However, when a large number of scanning signals (e.g., 135 scanning signals) in the non-selected state become the H level at the same time, the effect of improving the rising is obtained excessively, and an excessive current may flow in the display data lines DL. Thus, problems such as an increase in current consumption and an increase in noise may occur.

Therefore, as in the configuration example of FIG. 6, it is considered that a blanking period for the even-numbered scanning lines and a blanking period for the odd-numbered scanning lines are provided using two blanking signals BKa and BKb. Accordingly, the number of scanning signals which rise at one time is reduced to approximately half, and the appropriate effect of improving the rising is obtained.

In this regard, the scanning lines SL may be driven from both ends thereof by using the cathode driver 21 shown in FIG. 6. In this case, an IC chip of the cathode driver 21 of FIG. 6 is also disposed at the right side of the display unit 10.

Figure 8A:
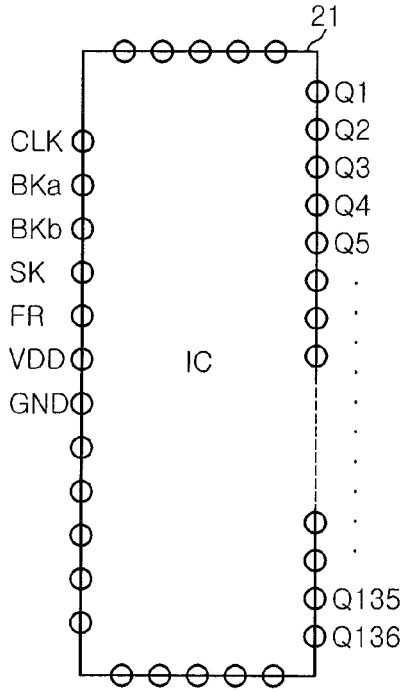
FIGS. 8A and 8B are views for explaining a case where the same ICs for driving the scanning lines are disposed at both ends of the scanning lines.

FIG. 8A schematically shows the IC chip of the cathode driver 21. Generally, the IC chip of the cathode driver 21 has the output terminals Q1 to Q136 which are arranged along one side of the chip and are connected to the scanning lines SL. This is proper for the wiring layout for the scanning lines SL1 to SL136. Further, in the example of FIG. 8A, various signal input terminals (terminals for, e.g., the clock signal CLK, the blanking signals BKa and BKb, and the scanning signal SK) are provided at the other side of the chip. This is also advantageous for the wiring layout on the board.

Figure 8B:
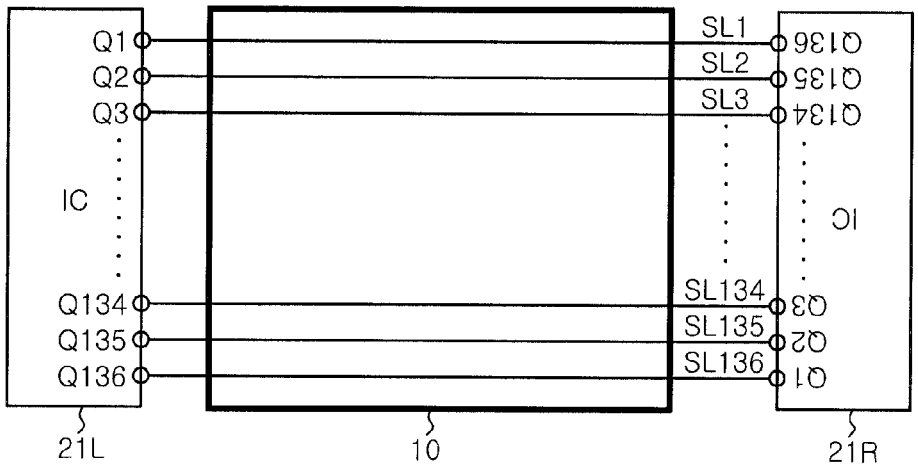

FIG. 8B shows an example where two IC chips, each serving as the cathode driver 21, are disposed on both sides of the display unit 10. Specifically, the IC chip as the cathode driver 21L is disposed on the left side of the display unit 10 and the IC chip as the cathode driver 21R is disposed on the right side thereof, the IC chip as the cathode driver 21R being arranged upside down. This is because it is preferable that the output terminals Q1 to Q136 of the chip are arranged to face terminals of the display unit 10 (scanning lines SL) in terms of the wiring layout.

Further, in driving the scanning lines, it is necessary to make the cathode drivers 21L and 21R select the same scanning line. To that end, the cathode driver 21L performs the forward direction scanning signal output (to select the scanning lines sequentially in the direction of Q1→Q136), and the cathode driver 21L performs the reverse direction scanning signal output (to select the scanning lines sequentially in the direction of Q136→Q1).

In this case, as described in connection with the configuration of the above embodiment, the output terminal Q1 of the cathode driver 21L and the output terminal Q136 of the cathode driver 21R are connected to the scanning line SL1. Further, the output terminal Q2 of the cathode driver 21L and the output terminal Q135 of the cathode driver 21R are connected to the scanning line SL2. Similarly, the other output terminals are connected to both ends of each of the scanning lines SL3 to SL136. Further, if the total number of scanning lines is even, one ends of the scanning lines SL1 to SL136 are connected to the odd-numbered output terminals of the cathode driver 21L, and the other ends thereof are connected to the even-numbered output terminals of the cathode driver 21R.

Figure 7B:
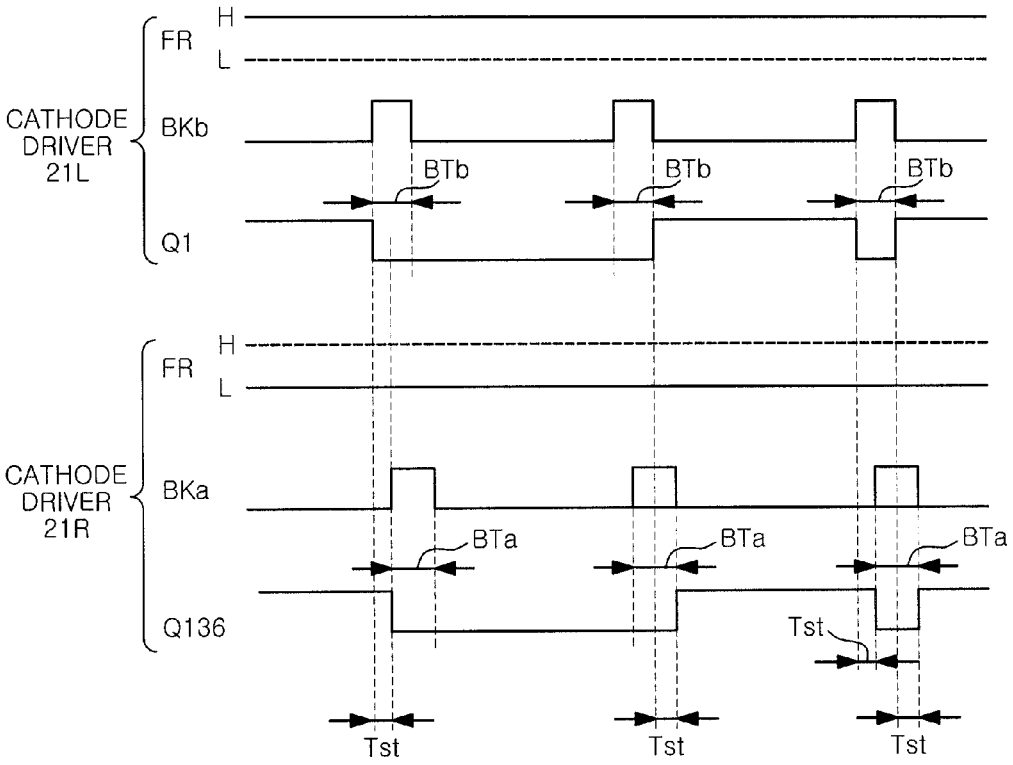
FIG. 7B (RELATED ART)

In the case where different blanking periods BT are respectively applied to the odd-numbered scanning lines and the even-numbered scanning lines by using the cathode driver 21 configured as shown in FIG. 6 as the cathode drivers 21L and 21R of FIG. 8B, an improper situation occurs. FIG. 7B shows outputs of the output terminal Q1 of the cathode driver 21L and the output terminal Q136 of the cathode driver 21R before and after the timing of selecting the scanning line SL1.

The cathode driver 21L performs the forward direction scanning signal output by the scanning direction control signal FR of the H level. Since the output terminal Q1 is the odd-numbered output terminal, the blanking period BTb is added as illustrated in response to the blanking signal BKb. The cathode driver 21R performs the reverse direction scanning signal output by the scanning direction control signal FR of the L level. Since the output terminal Q136 is the even-numbered output terminal, the blanking period BTa is added as illustrated in response to the blanking signal BKa.

The outputs of the output terminal Q1 and the output terminal Q136 are applied simultaneously to the scanning line SL1 as scanning signals. Thus, a period Tst occurs in which the H level is applied to one end of the scanning line SL1 and the L level is applied to the other end of the scanning line SL1. The period Tst is included in the blanking period BTa or BTb in which the display data signal output from the anode driver 33 is not performed as described above. Therefore, in the period Tst, different potentials between both ends of the scanning line SL1 do not directly affect the display image itself. However, since the potentials at both ends are different, unnecessary current flows from the H-level side to the L-level side in the scanning line SL1 during the period Tst. This is true for the other scanning lines SL2 to SL136.

As a result, wasteful current is generated in each scanning line SL, which may cause undesirable results such as an increase in power consumption, heat generation and noise generation. Further, in some cases, an increase in the current may cause IC failures.

With the display device according to the present embodiment, it is possible to prevent the occurrence of the wasteful current, and to achieve stable display driving. Specifically, with the configuration of FIG. 2, the period Tst as shown in FIG. 7B does not occur when driving the scanning lines.

As described above, the cathode drivers 21L and 21R are configured such that the blanking signals BKa and BKb supplied from the drive control unit 31 are selected by the selectors 45 and 46. In particular, the selection is performed based on the scanning direction control signal FR.

Thus, in the cathode driver 21L, as shown in FIG. 5, the blanking period BTb corresponding to the blanking signal BKb is applied to the scanning signal from the odd-numbered output terminal, and the blanking period BTa corresponding to the blanking signal BKa is applied to the scanning signal from the even-numbered output terminal. Further, in the cathode driver 21R, the blanking period BTa corresponding to the blanking signal BKa is applied to the scanning signal from the odd-numbered output terminal, and the blanking period BTb corresponding to the blanking signal BKb is applied to the scanning signal from the even-number output terminal.

As a result, the scanning signals of the same waveform, to which the same blanking period is applied, are applied to both ends of each scanning line SL. For example, the output of the drive circuit output terminal Q136 of the cathode driver 21R is the same scanning signal as that of the drive circuit output terminal Q1 of the cathode driver 21L. In this way, since the same scanning signal is applied to the both ends of each of the scanning lines SL1 to SL136, in the present embodiment, the period Tst as shown in FIG. 7B does not occur, thereby preventing unnecessary current from flowing.

In summary, in the present embodiment, the scanning line SL is driven at both ends thereof by the cathode drivers 21L and 21R, and two types of periods different in generation timing and respectively corresponding to the blanking signals BKa and BKb are applied as blanking periods.

Specifically, the cathode driver 21L serving as a scanning line driver performs the forward direction scanning signal output to sequentially select the scanning lines SL in the order from the first output terminal (the drive circuit output terminal Q1) to the $136^{th}$ output terminal (the drive circuit output terminal Q136) connected to the scanning lines SL1 to SL136. The cathode driver 21R serving as the other scanning line driver performs, in synchronization with the cathode driver 21L, the reverse direction scanning signal output to sequentially select the scanning lines SL in the order from the $136^{th}$ output terminal (the drive circuit output terminal Q136) to the first output terminal (the drive circuit output terminal Q1) connected to the scanning lines SL1 to SL136.

Further, the cathode driver 21L outputs scanning signals having the blanking period BTa corresponding to the blanking signal BKa to the scanning lines connected to the even-numbered output terminals while outputting scanning signals having the blanking period BTb corresponding to the blanking signal BKb to the scanning lines connected to the odd-numbered output terminals. The cathode driver 21R outputs scanning signals having the blanking period BTb corresponding to the blanking signal BKb to the scanning lines connected to the even-numbered output terminals while outputting scanning signals having the blanking period BTa corresponding to the blanking signal BKa to the scanning lines connected to the odd-numbered output terminals.

With the above configuration, the following effects can be obtained in the display device of the present embodiment.

First, since the scanning lines SL are driven at both ends thereof using the cathode drivers 21L and 21R, it is possible to maintain good display quality even in a large screen. Further, since the blanking periods are provided at different timings from each other in the scanning signals for the odd-numbered scanning lines and the even-numbered scanning lines, it is possible to optimize the display data signal output from the anode driver 33, which also contributes to the display quality improvement.

Further, in case blanking periods different from each other are applied to the odd-numbered scanning lines and the even-numbered scanning lines, even when both ends of each scanning line are respectively connected to the even-numbered or odd-numbered output terminal of the cathode driver 21L and the odd-numbered or even-numbered output terminal of the cathode driver 21R, the scanning signals applied to both ends of one scanning line are identical (there is no shift in the blanking period), so that a period in which unnecessary current flows does not occur. Thus, it is possible to prevent an increase in power consumption, heat generation, noise generation, and occurrence of chip failure. As a result, it is possible to operate the display device stably.

Further, the IC chips having the same configuration may be used as the cathode drivers 21L and 21R, and each of the cathode drivers 21L and 21R may be manufactured without using a dedicated IC. Thus, it is possible to obtain advantages such as a decrease in manufacturing cost, a reduction in the number of parts and the improvement of manufacturing efficiency.

In the present embodiment, each of the cathode drivers 21L and 21R has the selector 45 for supplying one of the blanking signals BKa and BKb respectively defining the blanking periods BTa and BTb to a scanning signal generating system that generates a scanning signal to be outputted from the odd-numbered output terminal, and the selector 46 for supplying the other one of the blanking signals BKa and BKb to a scanning signal generating system that generates a scanning signal to be outputted from the even-numbered output terminal. By using the selectors 45 and 46, it is possible to switch between the odd-numbered output terminal and the even-numbered output terminal to which the blanking signals BKa and BKb is applied, and use the same IC chip as the cathode drivers 21L or 21R.

Herein, the scanning signal generating system refers to the overall circuit for performing processes of generating the scanning signals to be outputted to the scanning lines SL. In the present embodiment, the scanning signal generating system includes the shift register 41, the latch circuit 42, the AND gates 43, the drive circuit 44 and the inverters 47 and 48.

Further, in the present embodiment, according to the scanning direction control signal FR, one of the cathode drivers 21L and 21R performs the forward direction scanning signal output and the other performs the reverse direction scanning signal output. The selectors 45 and 46 perform selection of the blanking signals BKa and BKb according to the scanning direction control signal FR. The blanking signals BKa and BKb are outputted to the odd-numbered output terminals or the even-numbered output terminals according to whether it is the forward direction scanning signal output or the reverse direction scanning signal output, and the same blanking period is applied to the same scanning line. Thus, the selector 45 and 46 can be properly driven by using the scanning direction control signal FR without providing additionally a selection control signal.

In the present embodiment, each of the cathode drivers 21L and 21R corresponds to a scanning line driver described in the claims. Specifically, each of the cathode drivers 21L and 21R includes m output terminals (m is an even number, and 136 in the present embodiment) connected to the scanning lines SL1 to SLm (SL136 in the present embodiment), respectively, and a scanning signal output unit for selectively performing the forward direction scanning signal output to sequentially select the scanning lines SL1 to SLm in the order from the first output terminal (for the drive circuit output Q1) to the m-th output terminal (for, e.g., the drive circuit output Q136), or the reverse direction scanning signal output to sequentially select the scanning lines SL in the order from the m-th output terminal to the first output terminal.

In the present embodiment, the scanning signal output unit includes the shift register 41, the latch circuit 42 and the drive circuit 44. Further, there are provided the selector 45 for applying one of the blanking signals BKa and BKb respectively defining the blanking periods BTa and BTb included in the scanning signals to the scanning signal generating system of the odd-numbered output terminal, and the selector 46 for applying the other one of the blanking signals BKa and BKb to the scanning signal generating system of the even-numbered output terminal.

With this configuration, switching between the odd-numbered and even-numbered output terminals to which the blanking signals BKa and BKb are applied may be achieved. Thus, the scanning line driver is applicable to any one of the cathode drivers 21L and 21R, and it is possible to provide the display device having the above-mentioned effects. In addition, the selectors 45 and 46 are configured to be switched according to whether the scanning signal output unit performs the forward or the reverse direction scanning signal output. This makes it possible to appropriately set the output destinations (e.g., odd-numbered output terminal or even-numbered output terminal) to which the blanking signals BKa and BKb are outputted.

Second Embodiment

A display device 1A in accordance with a second embodiment will be described with reference to FIGS. 9 and 10A and 10B.

The display device 1A includes a display unit 10A having two display panels 11 and 12 arranged adjacent to each other and driven independently of each other.

Figure 9:
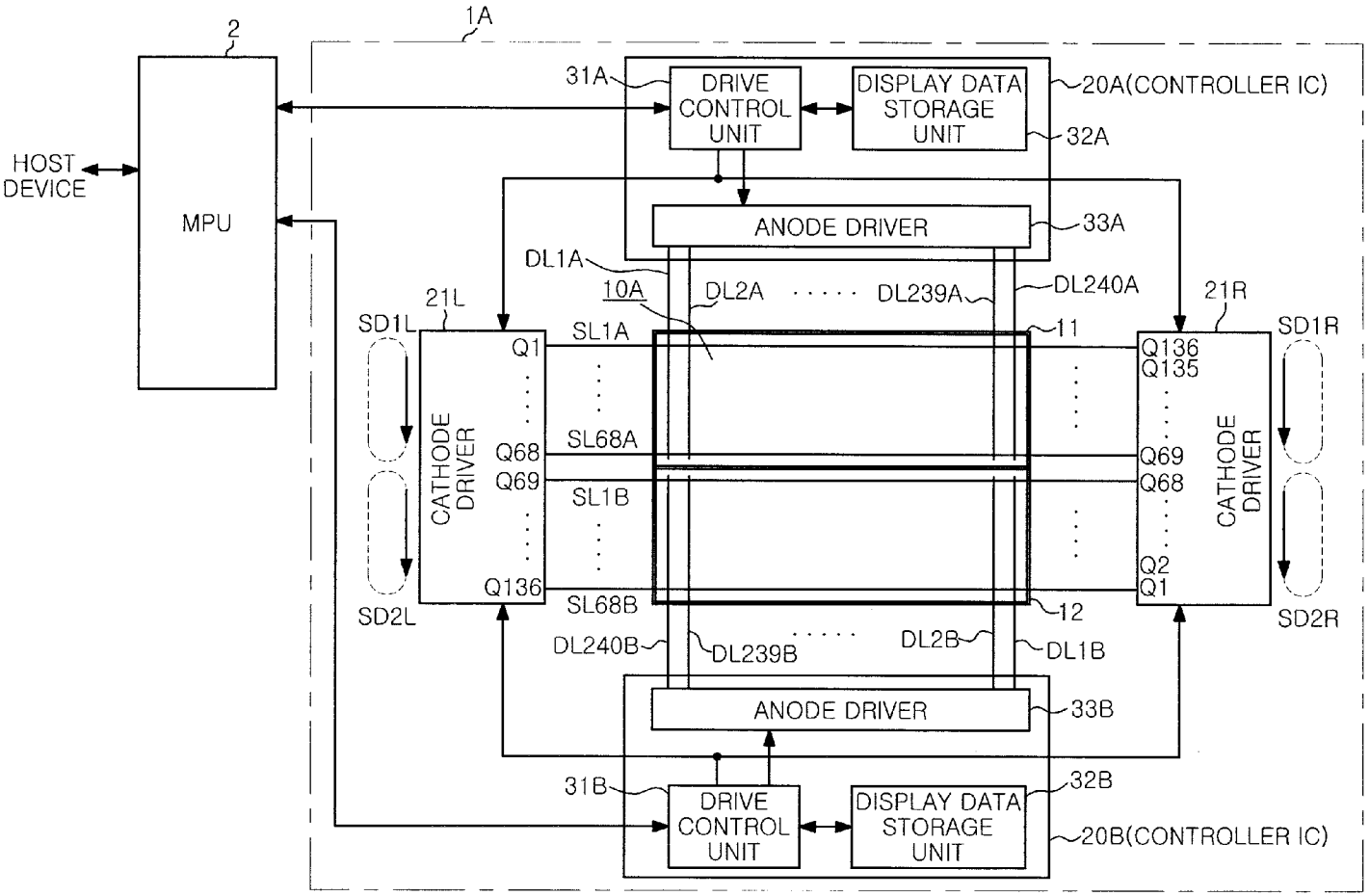
FIG. 9 is a block diagram of a display device in accordance with a second embodiment of the present invention.
Figure 10A:
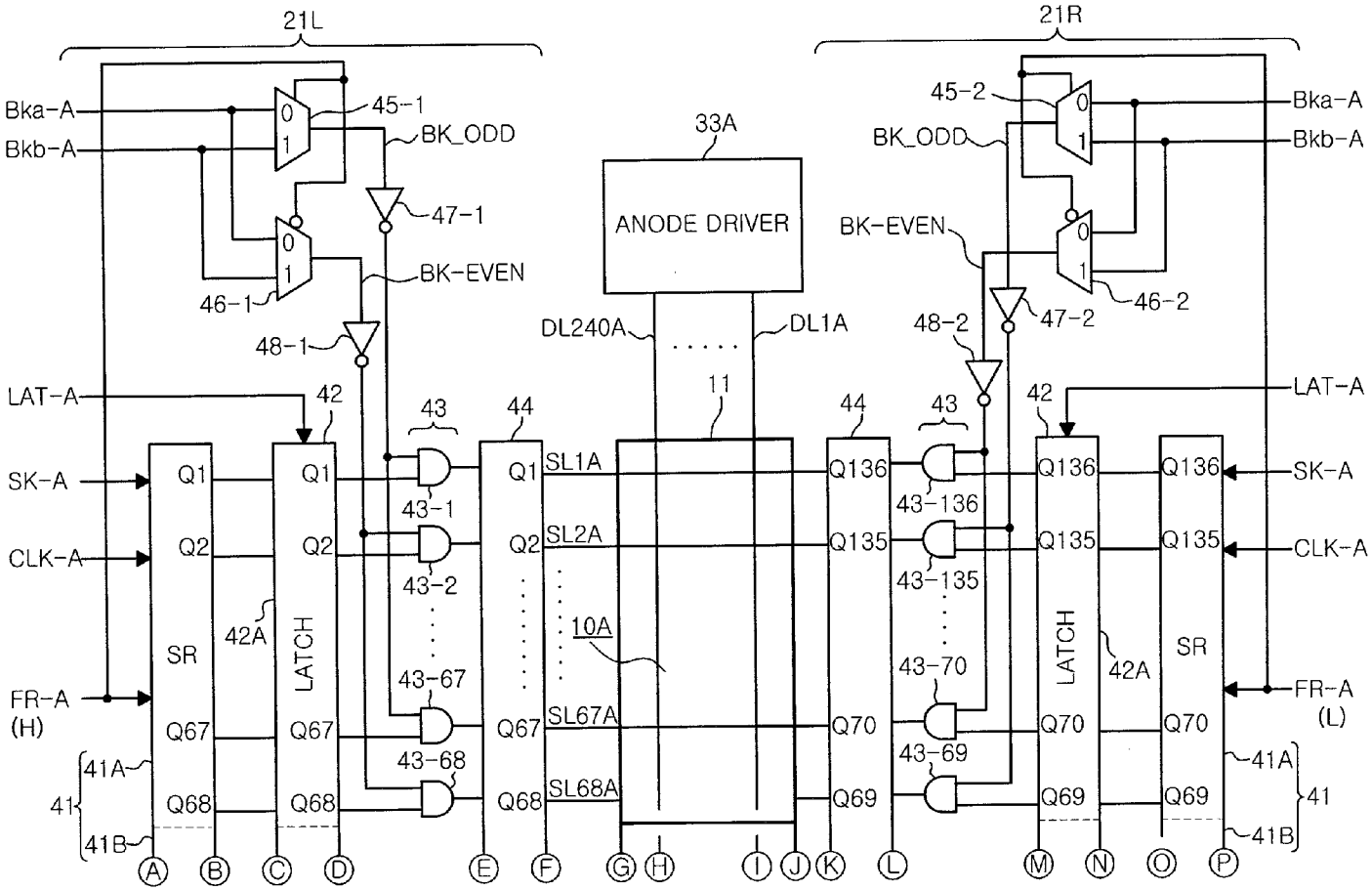
FIGS. 10A and 10B are views for showing a driving block of the second embodiment.
Figure 10B:
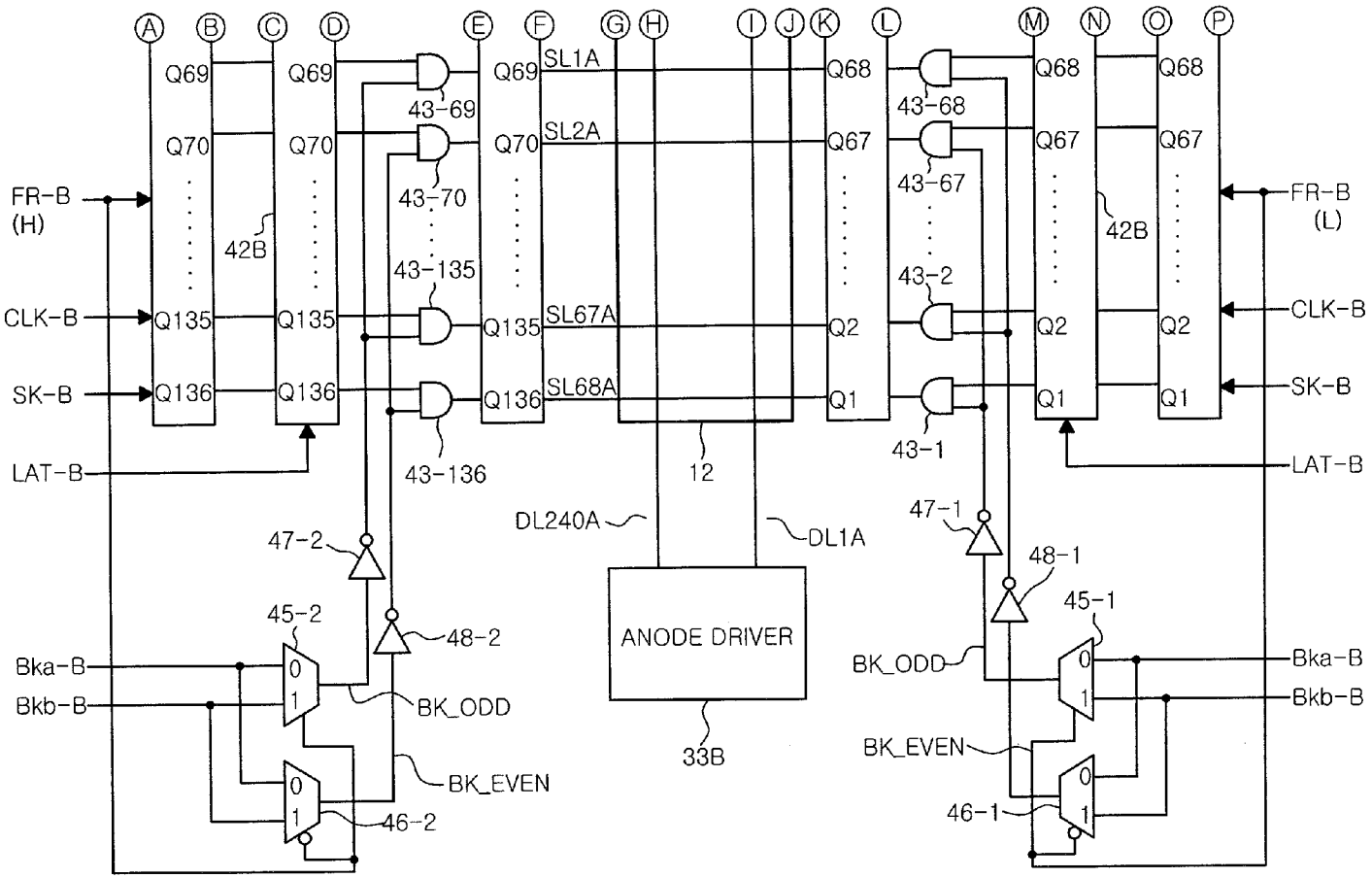

As shown in FIG. 9, a display area of the display unit 10A is formed of the display panel 11 and the display panel 12 disposed adjacent to each other in the direction of scanning the scanning lines (line scanning direction).

The display panel 11 and the display panel 12 have the same configuration. Specifically, the display unit 10A is constituted by the display panel 11 and the display panel 12 disposed on a sheet of glass. Each of the display panel 11 and the display panel 12 is configured such that, as effective pixels making up a display image, for example, 240 dots are arranged in the horizontal direction and 68 dots are arranged in the vertical direction (line scanning direction). Thus, each of the display panels 11 and 12 has 16320 (=240×68) effective dots. That is, the display unit 10A of this embodiment which includes two display panels 11 and 12 has the same number of dots as the display unit 10 of the first embodiment. Each dot is formed of a self-emitting element using an OLED.

In the display panel 11, display data lines DL1A to DL240A and scanning lines SL1A to SL68A are disposed. Similarly, in the display panel 12, display data lines DL1B to DL240B and scanning lines SL1B to SL68B are disposed. For the display panel 11, a controller IC 20A having a drive control unit 31A, a display data storage unit 32A and an anode driver 33A are disposed. For the display panel 12, a controller IC 20B having a drive control unit 31B, a display data storage unit 32B and an anode driver 33B are disposed. The controller ICs 20A and 20B have the same configuration as the controller IC 20 of the first embodiment.

Further, the cathode drivers 21L and 21R are arranged to be used in common for the display panels 11 and 12. Specifically, the cathode driver 21L is used for the scanning of the display panel 11 by connecting output terminals Q1 to Q68 to the scanning lines SL1A to SL68A, and used for the scanning of the display panel 12 by connecting output terminals Q69 to Q136 to the scanning lines SL1B to SL68B. The cathode driver 21R is used for the scanning of the display panel 11 by connecting output terminals Q136 to Q69 to the scanning lines SL1A to SL68A, and used for the scanning of the display panel 12 by connecting output terminals Q68 to Q1 to the scanning lines SL1B to SL68B.

The display panels 11 and 12 are scanned independently. For example, the display panel 11 is scanned such that the scanning lines SL1A, SL2A . . . SL68A are selected sequentially, and the display panel 12 is scanned such that the scanning lines SL1B, SL2B . . . SL68B are selected sequentially. Thus, in each of the cathode drivers 21L and 21R, 136 output terminals are divided into two groups. Then, the cathode driver 21L performs the forward direction scanning signal output represented by a scanning direction SD1L using the output terminals Q1 to Q68 for the display panel 11, and performs the forward direction scanning signal output represented by a scanning direction SD2L using the output terminals Q69 to Q136 for the display panel 12. The cathode driver 21R performs the reverse direction scanning signal output represented by a scanning direction SD1R using the output terminals Q136 to Q69 for the display panel 11, and performs the reverse direction scanning signal output represented by a scanning direction SD2R using the outputs Q68 to Q1 for the display panel 12.

Description will be made on operations and effects of the display device 1A in accordance with the present embodiment in which two sheets of the display panels 11 and 12 are disposed adjacent to each other to form the display unit 10A.

Generally, the display panel is configured to have one display data line (luminance control line) for all dots arranged in each vertical line, and one scanning line for all dots arranged in each horizontal line. For example, in the case of a display panel of 240 dots×136 dots, the display panel has 240 display data lines, each extending in the vertical direction, and 136 scanning lines, each extending in the horizontal direction.

Further, in the case of using, e.g., a line driving method, while selecting the scanning lines one by one by a scanning signal, a display data signal (luminance signal) is applied to each dot of the selected scanning line from the corresponding display data line to allow dots of the selected scanning line to emit light. This is performed sequentially from the first scanning line to the last scanning line so that one frame of the image display is displayed.

In the case of passively driving the display panel, only one line emits light at a time. As the size of the screen increases and the number of dots (lines) increases, the time for driving one dot is shortened and the luminance of the display image is accordingly reduced. Thus, in order to obtain an enough luminance, typically, it is necessary to increase the light emission luminance of each dot. This shortens the lifetime of dots. This is the same even in the case of a dot driving method.

In the present embodiment, as described above, two display panels 11 and 12 are disposed adjacent to each other to form the display unit 10A, and each of the display panels 11 and 12 constitutes the half of the screen. Then, the display panels 11 and 12 are driven independently. Thus, each of the display panels 11 and 12 is sufficiently driven by driving the half lines of the entire screen. In this case, it is possible to make driving time per one line longer. That is, for example, by using two display panels 11 and 12 of 240×68 dots instead of one display panel of 240×136 dots, two lines (one line of the display panel 11 and one line of the display panel 12) emit light at the same time, thereby doubling the duty cycle.

Further, by using the persistence of vision occurring in a person viewing the display unit 10, it is possible to double the luminance of the image displayed on the display unit 10 even if the dots of each line have the same luminance level. In other words, sufficient luminance can be obtained in the display image without greatly increasing the light emission luminance of the dots. As the above, as the configuration shown in FIG. 9, the method in which one screen is constituted by a plurality of panels which are driven independently is suitable for a larger screen and higher definition.

In the second embodiment, when driving the scanning lines SL of the display panels 11 and 12 using the cathode drivers 21L and 21R as shown in FIG. 9, scanning signals having shifted blanking periods are not applied to both ends of each of the scanning lines SL as in the first embodiment. To that end, the cathode drivers 21L and 21R are configured as shown in FIGS. 10A and 10B.

The cathode drivers 21L and 21R have the same configuration, and the cathode drivers 21L and 21R include a shift register 41, a latch circuit 42, AND gates 43 (43-1 to 43-136), a drive circuit 44, first selectors 45-1 and 45-2, second selectors 46-1 and 46-2, and inverters 47-1, 47-2, 48-1 and 48-2. Since the basic configuration is the same as the first embodiment except that each of the shift register 41, the latch circuit 42, and the AND gates 43 and the drive circuit 44 are divided into two groups corresponding to the display panels 11 and 12 in the present embodiment, a redundant description thereof will be omitted.

As for the cathode driver 21L, the configuration of the outputs Q1 to Q68 of the shift register 41 to the drive circuit 44 (hereinafter, referred to as a "first half group") corresponds to the display panel 11. As control signals for the first half group, a scanning signal SK-A, a clock signal CLK-A, a scanning direction control signal FR-A, a latch signal LAT-A, and blanking signals BKa-A and BKb-A for controlling the driving of the display panel 11 are supplied to the cathode driver 21L from the controller IC 20A (drive control unit 31A).

In the shift register 41, a first shift register part 41A of the first half group performs shift in the forward direction (in the direction of Q1→Q2→ . . . →Q68) in accordance with the scanning direction control signal FR-A of the H level to obtain the outputs Q1 to Q68. The outputs Q1 to Q68 of the first shift register part 41A are latched by a first latch part 42A of the latch circuit 42 in synchronization with the latch signal LAT-A, and the latch outputs Q1 to Q68 are supplied to the drive circuit 44 through the respective AND gates 43-1 to 43-68. Then, scanning signals are applied, as the drive circuit outputs Q1 to Q68, to scanning lines SL1A to SL68A of the display panel 11.

The selectors 45-1 and 46-1 and the inverters 47-1 and 48-1 correspond to the first half group. An output BK_ODD of the selector 45-1 is inputted through the inverter 47-1 to the odd-numbered AND gates 43 (43-1, 43-3, . . . , 43-67) among the AND gates 43-1 to 43-68. Further, an output BK_EVEN of the selector 46-1 is inputted to the even-numbered AND gates 43 (43-2, 43-4, . . . , 43-68) through the inverter 48-1. The blanking signal BKa-A is inputted to the input 0 of the selectors 45-1 and 46-1, and the blanking signal BKb-A is inputted to the input 1 of the selectors 45-1 and 46-1.

Further, each of the selectors 45-1 and 46-1 selects the input 0 or 1 according to the scanning direction control signal FR-A. The scanning direction control signal FR-A is inputted as it is to the selector 45-1 as a selection control signal, whereas the scanning direction control signal FR-A is inverted and inputted as it is to the selector 46-1 as a selection control signal. The selector 45-1 selects the input 1 if the selection control signal has the H level, and selects the input 0 if the selection control signal has the L level. The selector 46-1 selects the input 0 if the selection control signal has the H level, and selects the input 1 if the selection control signal has the L level. For example, when the scanning direction control signal FR-A has the H level, the output BK_ODD of the selector 45-1 is the blanking signal BKb-A, and the output BK_EVEN of the selector 46-1 is the blanking signal BKa-A.

Further, in the cathode driver 21L, the configuration the outputs Q69 to Q136 of the shift register 41 to the drive circuit 44 (hereinafter, referred to as a "second half group") corresponds to the display panel 12. As control signals for the second half group, a scanning signal SK-B, a clock signal CLK-B, a scanning direction control signal FR-B, a latch signal LAT-B, and blanking signals BKa-B and BKb-B for controlling the driving of the display panel 12 are supplied to the cathode driver 21L from the controller IC 20B (drive control unit 31B).

In the shift register 41, a second shift register part 41B of the second group performs shift in the reverse direction (in the direction of Q69→Q70→ . . . →Q136) in accordance with the scanning direction control signal FR-B of the H level to obtain the outputs Q69 to Q136. The outputs Q69 to Q136 of the second shift register part 41B are latched by a second latch part 42B of the latch circuit 42 in synchronization with the latch signal LAT-B, and the latch outputs Q69 to Q136 are supplied to the drive circuit 44 through the respective AND gates 43-69 to 43-136. Then, scanning signals are applied, as drive circuit outputs Q69 to Q136, to scanning lines SL1B to SL68B of the display panel 12.

The selectors 45-2 and 46-2 and the inverters 47-2 and 48-2 correspond to the second half group. An output BK_ODD of the selector 45-2 is inputted through the inverter 47-2 to the odd-numbered AND gates 43 (43-69, 43-71, . . . , 43-135) among the AND gates 43-69 to 43-136. Further, an output BK_EVEN of the selector 46-2 is inputted to the even-numbered AND gates 43 (43-70, 43-72, . . . , 43-136) through the inverter 48-2. The blanking signal BKa-B is inputted to the inputs 0 of the selectors 45-2 and 46-2, and the blanking signal BKb-B is inputted to the inputs 1 of the selectors 45-2 and 46-2.

Further, each of the selectors 45-2 and 46-2 selects the input according to the scanning direction control signal FR-B. The scanning direction control signal FR-B is inputted as it is to the selector 45-2 as a selection control signal, whereas the scanning direction control signal FR-B is inverted and inputted to the selector 46-2 as a selection control signal. The selector 45-2 selects the input 1 if the selection control signal has the H level, and selects the input 0 if the selection control signal has the L level. The selector 46-2 selects the input 0 if the selection control signal has the H level, and selects the input 1 if the selection control signal has the L level. For example, when the scanning direction control signal FR-B has the H level, the output BK_ODD of the selector 45-2 is the blanking signal BKb-B, and the output BK_EVEN of the selector 46-2 is the blanking signal BKa-B.

The cathode driver 21R has the same configuration as the cathode driver 21L except that the cathode driver 21R is arranged upside down with respect to the display unit 10A, and the cathode driver 21R has a connection relationship between the output terminals Q1 to Q136 and the scanning lines SL1 to SL136 opposite to that of the cathode driver 21L, as described with reference to FIG. 8. Accordingly, the first half group (Q1 to Q68) corresponds to the display panel 12, and the second half group (Q69 to Q136) corresponds to the display panel 11.

As control signals for the first half group, the scanning signal SK-B, the clock signal CLK-B, the latch signal LAT-B, and the blanking signals BKa-B and BKb-B for controlling the driving of the display panel 12 are supplied to the cathode driver 21R from the controller IC 20B (drive control unit 31B) at the same time with those for the second half group of the cathode driver 21L. Specifically, if the scanning direction control signal FR-B is supplied at the L level, the first half group (Q1 to Q68) of the cathode driver 21R performs the reverse direction scanning signal output (scanning in the direction of Q68→Q67→ . . . →Q1). In addition, the blanking signals BKa-B and BKb-B in the selectors 45-1 and 46-1 are selected is contrary to those in the selectors 45-2 and 46-2 of the cathode driver 21L.

Further, as control signals for the second half group, the scanning signal SK-A, the clock signal CLK-A, the latch signal LAT-A, and the blanking signals BKa-A and BKb-A for controlling the driving of the display panel 11 are supplied to the cathode driver 21R from the controller IC 20A (drive control unit 31A) at the same time with those for the first half group of the cathode driver 21L. Specifically, if the scanning direction control signal FR-A is supplied at the L level, the second half group (Q69 to Q136) of the cathode driver 21R performs the reverse direction scanning signal output (scanning in the direction of Q136→Q135→ . . . →Q69). In addition, the blanking signals BKa-A and BKb-A in the selectors 45-2 and 46-2 are selected contrary to those in the selectors 45-1 and 46-1 of the cathode driver 21L.

Accordingly, each of the scanning lines SL of the display panels 11 and 12 is driven from both ends thereof by the cathode drivers 21L and 21R, and the same scanning signals (to which the same blanking period is applied) can be applied to both ends of the corresponding scanning line. As in the first embodiment, it is possible to prevent wasteful current from flowing. Further, even in the display unit 10A using the display panels 11 and 12, since IC chips having the same configuration may be used as the cathode drivers 21L and 21R, it is possible to operate the display device stably.

Further, as described above, by dividing the internal circuit of the cathode drivers 21L and 21R into the two groups corresponding to the display panels 11 and 12, one cathode driver IC may be used in common for scanning line drivers corresponding to the display panels 11 and 12.

Modification Example

Although the embodiments have been described as above, the display device and the scanning line driver of the present invention are not limited to the above embodiments, and various modifications thereof are conceivable.

Other configurations for the display driving of the display device are considered. For example, the anode driver 33 may be provided as an external configuration of the controller IC 20. Further, the scanning direction control signals FR for the cathode drivers 21L and 21R may be respectively supplied as independent signals (one signal of the H level and the other signal of the L level) to the cathode drivers 21L and 21R from the drive control unit 31, and the scanning direction control signal FR that is supplied to the cathode driver 21L may be supplied to the cathode driver 21R through an inverter.

Particularly, the potential of the fixed H level applied to the cathode driver 21L, and the potential of the fixed L level applied to the cathode driver 21L may be used as the scanning direction control signals FR. As for the selectors 45 and 46, an example of performing selection according to the scanning direction control signal FR has been illustrated, but the selectors 45 and 46 may be controlled using a selection control signal different from the scanning direction control signal FR.

Further, the display unit 10A has been configured using two display panels 11 and 12 in the second embodiment, but three or more display panels may be used. In addition, in the second embodiment, separate ICs may be used as the cathode driver for the display panel 11 and the cathode driver for the display panel 12. The present invention includes any configurations in which scanning signals having the same blanking periods can be applied to each scanning line through both ends thereof by the cathode drivers 21L and 21R.

Further, the present invention is applicable to other types of display devices using a liquid crystal display (LCD), a vacuum fluorescent display (VFD), a field emission display (FED) or the like as well as the display device using OLED.

While the invention has been shown and described with respect to the embodiments, it will be understood by those skilled in the art that various changes and modification may be made without departing from the scope of the invention as defined in the following claims.

What is claimed is:

1. A display device comprising:

a display unit in which data lines connected in common to a plurality of pixels arranged in a column direction and m scanning lines connected in common to a plurality of pixels arranged in a row direction are arranged in a matrix, m being the number of the scanning lines, and m being an even number;

a data line drive unit for applying a signal corresponding to display data to each of the data lines;

a first scanning line drive unit for applying a scanning signal to one end of each of the scanning lines; and a second scanning line drive unit for applying a scanning signal to the other end of each of the scanning lines, wherein the first scanning line drive unit has a first to a m-th output terminals connected respectively to the first to the m-th scanning lines and performs a forward direction scanning signal output in response to a first scanning direction control signal to sequentially select the scanning lines in the order from the first output terminal to the m-th output terminal, wherein the second scanning line drive unit has a m-th to a first output terminals connected respectively to the first to the m-th scanning lines and, in synchronization with the first scanning line drive unit, performs a reverse direction scanning signal output in response to a second scanning direction control signal to sequentially select the scanning lines in the order from the m-th output terminal to the first output terminal wherein a level of the first scanning direction control signal and a level of the second scanning direction control signal are different from each other, wherein the first scanning line drive unit outputs scanning signals having a first blanking period from the odd-numbered output terminals, and outputs scanning signals having a second blanking period from the even-numbered output terminals, the second blanking period being shifted from the first blanking period, wherein the second scanning line drive unit outputs scanning signals having the second blanking period from the odd-numbered output terminals, and outputs scanning signals having the first blanking period from the even-numbered output terminals, wherein each of the first scanning line drive unit and the second scanning line drive unit comprises:

a first selector configured to select one of a first blanking signal defining the first blanking period and a second blanking signal defining the second blanking period to thereby make the scanning signals to be outputted from the odd-numbered output terminals have a blanking period defined by the blanking signal selected by the first selector; and a second selector configured to select the other of the first blanking signal and the second blanking signal to thereby make the scanning signals to be outputted from the even-numbered output terminals have a blanking period defined by the blanking signal selected by the second selector, wherein the level of the first scanning direction control signal and the level of the second scanning direction control signal are different from each other, wherein the first scanning direction control signal and the second scanning direction control signal are respectively inputted to the first selector of the first scanning line drive unit and the first selector of the second scanning line drive unit, wherein an inverted first scanning direction control signal and an inverted second scanning direction control signal are respectively inputted to the second selector of the first scanning line drive unit and the second selector of the second scanning line drive unit, and wherein each of the first and the second selectors of the first and the second scanning line drive unit is configured to select the first blanking signal or the second blanking signal depending on a level of a scanning direction control signal inputted thereto.

2. A scanning line driver for applying scanning signals to m scanning lines of a display unit in which data lines connected in common to a plurality of pixels arranged in a column direction and the scanning lines connected in common to a plurality of pixels arranged in a row direction are arranged in a matrix, m being an even number and the number of the scanning lines, the scanning line driver comprising:

a scanning signal output unit, which has m output terminals respectively connected to the m scanning lines, configured to, when m is an even number, selectively perform a forward direction scanning signal output to sequentially select the scanning lines in the order from the first to the m-th output terminals, or a reverse direction scanning signal output to sequentially select the scanning lines in the order from the m-th to the first output terminals in response to a scanning direction control signal;

a first selector configured to select one of a first blanking signal defining a first blanking period to be included in the scanning signals and a second blanking signal defining a second blanking period to thereby make the scanning signals to be outputted from the odd-numbered output terminals have a blanking period defined by the blanking signal selected by the first selector, the second blanking period being shifted in timing from the first blanking period; and a second selector configured to select the other one of the first blanking signal and the second blanking signal to thereby make the scanning signals to be outputted from the even-numbered output terminals have a blanking period defined by the blanking signal selected by the second selector, wherein the scanning direction control signal is inputted to the first selector, wherein an inverted scanning direction control signal is inputted to the second selector, and wherein each of the first and the second selector is configured to select the first blanking signal or the second blanking signal depending on a level of the scanning direction control signal inputted thereto in accordance with whether the scanning signal output unit performs the forward direction scanning signal output or the reverse direction scanning signal output.

* * * * *